US009855750B2

(12) United States Patent
Akahane

(10) Patent No.: US 9,855,750 B2
(45) Date of Patent: Jan. 2, 2018

(54) LIQUID EJECTING HEAD AND LIQUID EJECTING APPARATUS

(71) Applicant: SEIKO EPSON CORPORATION, Tokyo (JP)

(72) Inventor: Fujio Akahane, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 4 days.

(21) Appl. No.: 14/835,099

(22) Filed: Aug. 25, 2015

(65) Prior Publication Data

US 2016/0067966 A1 Mar. 10, 2016

(30) Foreign Application Priority Data

Sep. 5, 2014 (JP) ..... 2014-181244

(51) Int. Cl.
*B41J 2/155* (2006.01)
*B41J 2/14* (2006.01)

(52) U.S. Cl.
CPC ..... *B41J 2/155* (2013.01); *B41J 2/14201* (2013.01); *B41J 2002/14362* (2013.01); *B41J 2202/20* (2013.01)

(58) Field of Classification Search
CPC ... B41J 2/195; B41J 2/045; B41J 2/155; B41J 2/14201; B41J 2202/20; B41J 2002/14362
See application file for complete search history.

(56) References Cited

U.S. PATENT DOCUMENTS

2005/0046668 A1* 3/2005 Owaki ..... B41J 2/14145 347/44
2012/0038709 A1* 2/2012 Owaki ..... B41J 2/17513 347/40

FOREIGN PATENT DOCUMENTS

| | | | |
|---|---|---|---|
| JP | 3019037 | A | 1/2000 |
| JP | 2005-096419 | A | 4/2005 |
| JP | 2007-090692 | A | 4/2007 |
| JP | 2011-183647 | A | 9/2011 |
| JP | 5327968 | A | 8/2013 |

* cited by examiner

*Primary Examiner* — Alessandro Amari
*Assistant Examiner* — Roger W Pisha, II
(74) *Attorney, Agent, or Firm* — Workman Nydegger

(57) ABSTRACT

A liquid ejecting head includes a plurality of liquid ejecting modules each of which includes a plurality of unit heads each configured to eject liquid from a plurality of nozzles, and a first fixing plate having a first surface where the plurality of unit heads are fixed; and a second fixing plate having a base portion fixed to a second surface of the first fixing plate of the plurality of liquid ejecting modules, the second surface located on the side opposite to the first surface, and the base portion overlapping a gap between the adjacent liquid ejecting modules.

16 Claims, 8 Drawing Sheets

LIQUID EJECTING HEAD AND LIQUID EJECTING APPARATUS

CROSS REFERENCES TO RELATED APPLICATIONS

This application claims priority to Japanese Patent Application No. 2014-181244 filed on Sep. 5, 2014. The entire disclosure of Japanese Patent Application No. 2014-181244 is hereby incorporated herein by reference.

BACKGROUND

1. Technical Field

The present invention relates to a technology of ejecting liquid, such as ink.

2. Related Art

Hitherto, a technology of ejecting liquid, such as ink, from a plurality of nozzles has been proposed. A liquid ejecting module (in other words, a head unit) having a structure in which a plurality of heads are fixed to one surface of a common fixing plate is disclosed in, for example, JP-A-2005-96419. The other surface of the fixing plate is fixed to a cover head for protecting each head.

In a case of the configuration of JP-A-2005-96419, to expand a distribution range of a plurality of nozzles, it is necessary to arrange a plurality of liquid ejecting modules. However, in a case of the configuration in which a plurality of liquid ejecting modules are arranged, liquid can enter a gap between adjacent liquid ejecting modules. Furthermore, there is a possibility that liquid staying in the gap between the liquid ejecting modules may adhere to a medium, such as a printing paper sheet.

SUMMARY

An advantage of some aspects of the invention is to prevent liquid from entering a gap between liquid ejecting modules.

Aspect 1

According to Aspect 1, there is provided a liquid ejecting head including: a plurality of liquid ejecting modules each of which has a plurality of unit heads each configured to eject liquid from a plurality of nozzles, and a first fixing plate having a first surface where the plurality of unit heads are fixed; and a second fixing plate having a base portion fixed to a second surface of the first fixing plate of the plurality of liquid ejecting modules, the second surface located on the side opposite to the first surface, the base portion overlapping a base portion that overlaps a gap between the adjacent liquid ejecting modules. In this case, the base portion of the second fixing plate overlaps the gap between the liquid ejecting modules, and thus the liquid can be prevented from entering the gap. Furthermore, the plurality of unit heads are fixed to the first surface of the first fixing plate and the second surface on the side opposite to the first surface is fixed to the second fixing plate. Accordingly, there is an advantage in that the positions of the respective unit heads can be set to the plurality of liquid ejecting modules with high accuracy, compared to, for example, a configuration in which the plurality of liquid ejecting modules are fixed to a reference surface on the side opposite to the first fixing plate with the respective unit heads interposed therebetween.

Aspect 2

In the liquid ejecting head according to Aspect 2, a first opening portion corresponding to the unit head may be formed in the first fixing plate, a second opening portion corresponding to the unit head may be formed in the second fixing plate, and, in a plan view, the size of the second opening portion may be greater than that of the first opening portion. In this case, in a plan view, the size of the second opening portion is greater than that of the first opening portion. Thus, there is an advantage in that, even when an error occurs in the position of each liquid ejection module in relation to the second fixing plate, a possibility that a part of the first opening portion or the entirety of the first opening portion may be closed by the second fixing plate can be reduced.

Aspect 3

In the liquid ejecting head according to Aspect 3, the plurality of liquid ejecting modules may be aligned in a first direction, and the second fixing plate may include a side wall portion which extends from a peripheral edge of the base portion, which extends in the first direction, to each liquid ejecting module side and may overlap a gap between the adjacent liquid ejecting modules. In this case, the side wall portion of the second fixing plate overlaps the gap between the respective liquid ejecting modules. Thus, the above-described effect that the liquid can be prevented from entering the gap is particularly significant.

Aspect 4

In the liquid ejecting head according to Aspect 4, an angle between the side wall portion and the base portion may be an obtuse angle. In this case, the angle between the side wall portion and the base portion is an obtuse angle. Thus, when a target which receives the liquid ejected by the liquid ejecting head reaches the side wall portion, the target receiving the ejected liquid can be guided (in other words, induced) to the base portion side along the side wall portion. Accordingly, there is an advantage in that a possibility that movement of the target receiving the ejected liquid may be hindered by the side wall portion and a possibility that deformation of the target receiving the ejected liquid may occur due to collision between the target receiving the ejected liquid and the side wall portion can be reduced.

Aspect 5

The liquid ejecting head according to Aspect 5 may further include a support body which supports the plurality of liquid ejecting modules, and the second fixing plate may be fixed to the support body. In this case, the second fixing plate is fixed to the support body which supports the plurality of liquid ejecting modules (in other words, the mechanical strength of the second fixing plate is reinforced). Thus, deformation of the second fixing plate can be prevented.

Aspect 6 and Aspect 7

In the liquid ejecting head according to Aspect 6, a thickness of the second fixing plate may be greater than that of the first fixing plate. In this case, the thickness of the second fixing plate is greater than that of the first fixing plate, and thus there is an advantage in that it is easy for the second fixing plate to have the mechanical strength necessary to support the plurality of liquid ejecting modules. Furthermore, in the liquid ejecting head according to Aspect 7, a thickness of the first fixing plate may be greater than that of the second fixing plate. In this case, the thickness of the second fixing plate is less than that of the first fixing plate, and thus the gap between the nozzles of each unit head and the target receiving the ejected liquid is reduced. Accordingly, there is an advantage in that an error in a liquid landing position can be reduced in relation to the target receiving the ejected liquid.

Aspect 8

According to Aspect 8 of the invention, there is provided a liquid ejecting head including the above-described liquid ejecting head. A preferred example of the liquid ejecting apparatus is a printing apparatus which ejects ink onto the medium, such as a printing paper sheet. However, the use of the liquid ejecting apparatus according to the invention is not limited to printing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Figure 1:
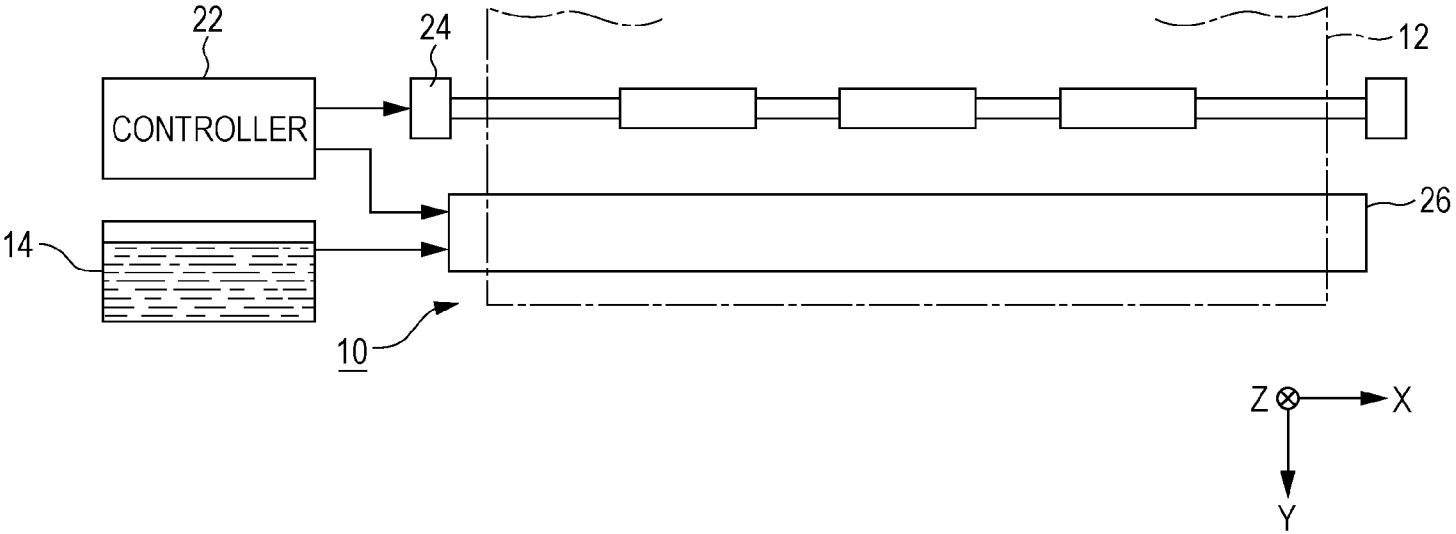
FIG. 1 is a configuration view of a printing apparatus according to Embodiment 1 of the invention.

FIG. 1 is a partial configuration view of an ink jet type printing apparatus 10 according to Embodiment 1 of the invention. The printing apparatus 10 of Embodiment 1 is a liquid ejecting apparatus which ejects, onto a medium (in other words, a target receiving ejected ink) 12, such as a printing paper sheet, ink as an example of liquid. The printing apparatus 10 of Embodiment 1 includes a controller 22, a transporting mechanism 24, and a liquid ejecting head 26. A liquid container (in other words, a cartridge) 14 in which ink is stored is mounted on the printing apparatus 10.

The controller 22 controls all components of the printing apparatus 10. The transporting mechanism 24 transports a medium 12 in a Y direction, in accordance with control by the controller 22. The liquid ejecting head 26 ejects, onto the medium 12, the ink supplied from the liquid container 14, in accordance with the control by the controller 22. The liquid ejecting head 26 of Embodiment 1 is a line head which extends in an X direction crossing (generally, perpendicular to) the Y direction. The liquid ejecting head 26 ejects the ink onto the medium 12 while the medium 12 is transported by the transporting mechanism 24, in such a manner that a predetermined image is formed on a surface of the medium 12. Hereinafter, a direction perpendicular to an X-Y plane (which is a plane parallel to the surface of the medium 12) will be referred to as a Z direction. An ink ejection direction (in other words, a lower side in a vertical direction) by the liquid ejecting head 26 corresponds to the Z direction.

Figure 2:
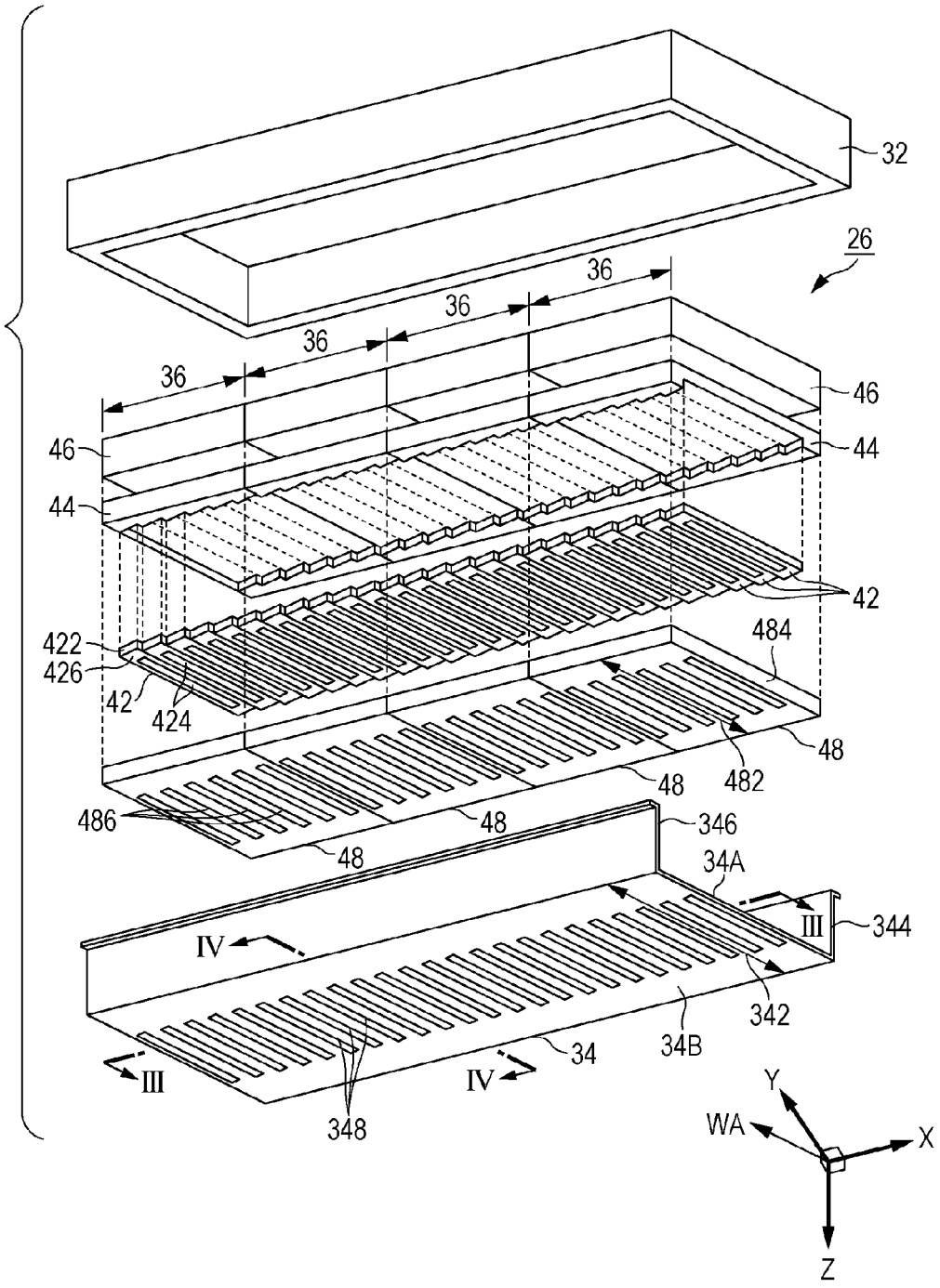
FIG. 2 is an exploded perspective view of a liquid ejecting head.

FIG. 2 is an exploded perspective view of the liquid ejecting head 26. The liquid ejecting head 26 of Embodiment 1 includes a support body 32, a fixing plate 34, and a plurality (which is four, in Embodiment 1) of liquid ejecting modules 36, as illustrated in FIG. 2. The support body 32 is a structure body (in other words, a frame) which supports the plurality of liquid ejecting modules 36. The support body 32 is formed by, for example, diecast molding of a metal material or injection molding of a resin material. The plurality of liquid ejecting modules 36 are supported in a portion between the support body 32 and the fixing plate 34, in a state where the liquid ejecting modules 36 are arranged in the X direction, as illustrated in FIG. 2.

Figure 3:
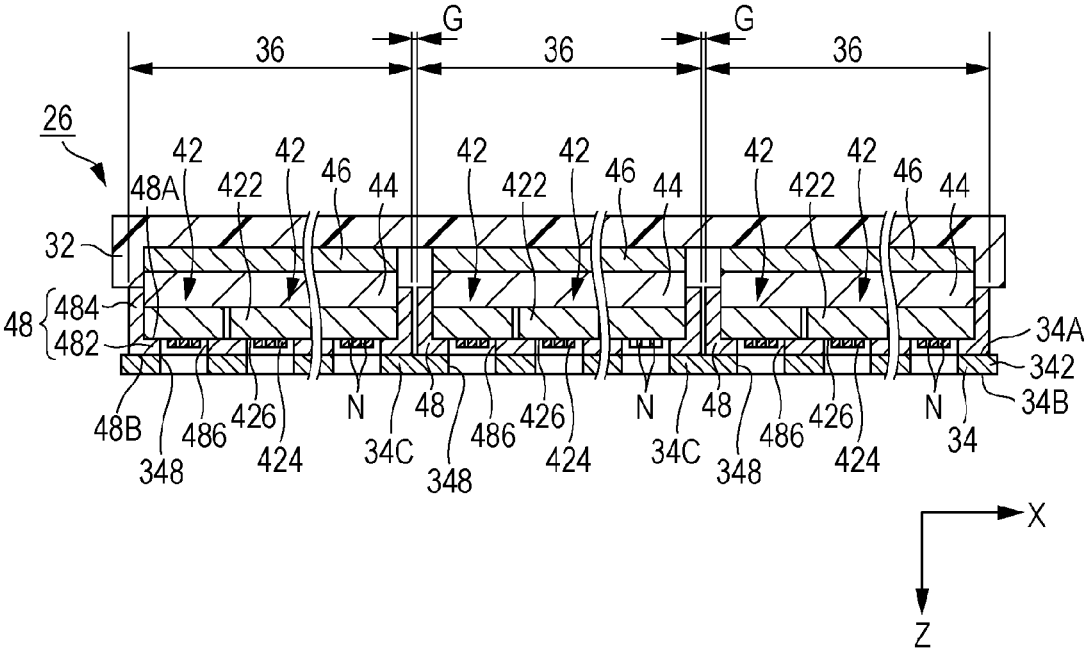
FIG. 3 is a cross-sectional view taken along the line III-III of FIG. 2.
Figure 4:
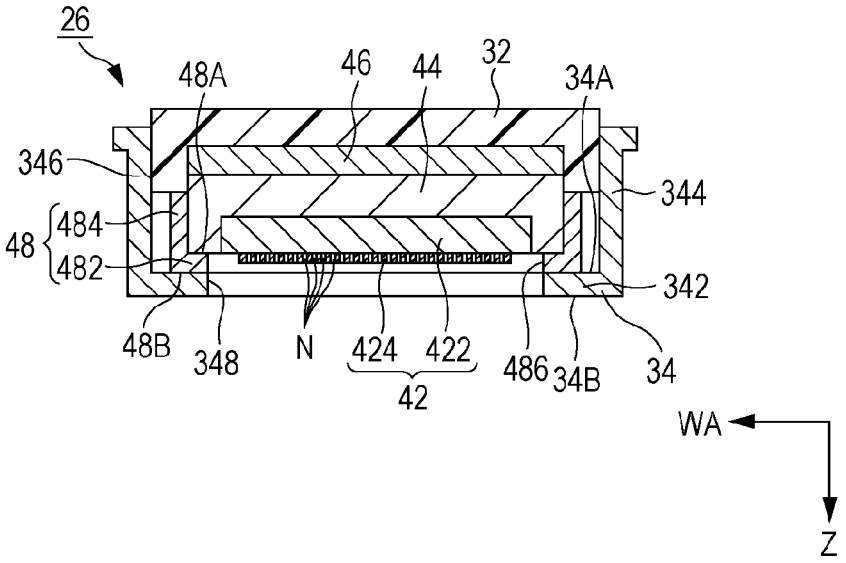
FIG. 4 is a cross-sectional view taken along the line IV-IV of FIG. 2.

FIG. 3 is a cross-sectional view (which is a cross-sectional surface parallel to an X-Z plane) taken along a line III-III of FIG. 2. FIG. 4 is a cross-sectional view taken along a line IV-IV of FIG. 2. Each of the plurality of liquid ejecting modules 36 includes a plurality (which is six, in Embodiment 1) of unit heads 42, a casing body 44, a flow path body 46, and a fixing plate 48, as illustrated in FIGS. 2 to 4. The casing body 44 is a structure body which supports the plurality of unit heads 42. The casing body 44 is formed by, for example, injection molding of a resin material or diecast molding of a metal material. The flow path body 46 is a structure body in which a flow path for supplying the ink stored in the liquid container 14 to each unit head 42 and a valve structure for opening/closing the flow path or controlling pressure are formed. The flow path body 46 is provided on a side opposite to the plurality of unit heads 42, with the support body 32 interposed therebetween. Furthermore, it can be configured so that the casing body 44 and the flow path body 46 are integrally formed.

Each unit head 42 is a head chip in which the ink is ejected from a plurality of nozzles (in other words, ejection holes) N. The unit head 42 of Embodiment 1 includes a main body portion 422 and a nozzle plate 424, as illustrated in FIGS. 2 to 4. The nozzle plate 424 is a long plate member on which a plurality of nozzles N are formed. The nozzle plate 424 is fixed to a part of the main body portion 422, which is a surface 426 on a positive side (in other words, the medium 12 side) in a Z direction. The main body portion 422 of Embodiment 1 includes a plurality (not illustrated) of groups of pressure chambers and piezoelectric elements which correspond to, for example, different nozzles N. The piezoelectric element is oscillated by receiving a driving signal and the pressure in the pressure chamber is changed, in such a manner that the ink filled into the pressure chamber is ejected from the respective nozzles N of the nozzle plate 424.

Figure 5:
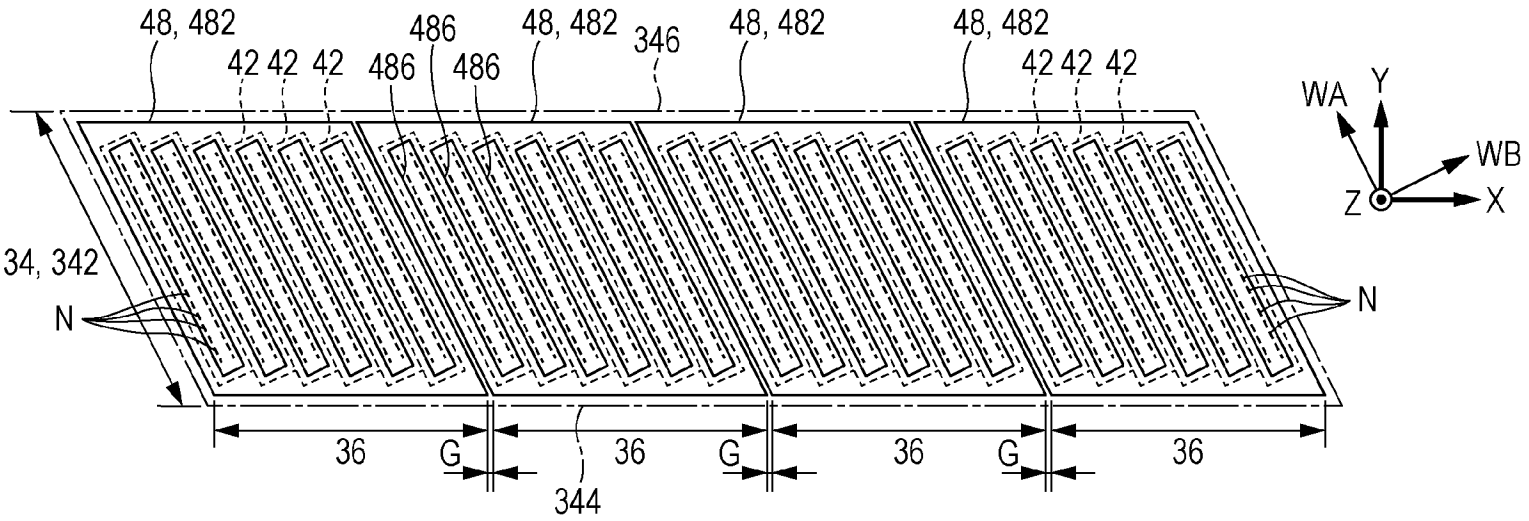
FIG. 5 is a plan view of a part of the liquid ejecting head, which is a surface facing a medium.

FIG. 5 is a plan view of a part of the plurality of liquid ejecting modules 36, which is a surface facing the medium 12. A plurality of unit heads 42 of each liquid ejecting module 36 are supported by the casing body 44, in a state where the unit heads 42 are aligned in the X direction, as illustrated in FIG. 5. The plurality of nozzles N of each unit head 42 are aligned in a WA direction in the Z-Y plane. In the X-Y plane, the WA direction is a direction which non-perpendicularly crosses both the X direction and the Y direction. Specifically, the WA direction is inclined with respect to the Y direction at angles equal to or greater than 30° and equal to or less than 60°. In Embodiment 1, the plurality of nozzles N are aligned in the WA direction inclined to the Y direction in which the medium 12 is transported, as described above. Thus, the practical dot density (in other words, resolution) in the X direction of the medium 12 can be increased, compared to in a case where a plurality of nozzles N are aligned in a straight line shape, in the X direction.

The fixing plate 48 (in other words, a first fixing plate) of FIG. 2 and the casing body 44 support the plurality of unit heads 42. The fixing plate 48 of Embodiment 1 includes a base portion 482 and a side wall portion 484, as illustrated in FIGS. 2 to 4. The base portion 482 has a plate shape of which the thickness is substantially the same over the entirety of the surface thereof. The side wall portion 484 extends from each edge side of the base portion 482 to a negative side (in other words, a first surface 48A side) in the Z direction. A material and a manufacturing method of the fixing plate 48 are not limited. However, the fixing plate 48 can be formed by, for example, bending a plate member formed of a high-rigidity material, such as a stainless steel.

The base portion 482 of the fixing plate 48 is formed in a shape (specifically, a parallelogram shape) and a size in which, in a plan view, the base portion 482 and the plurality of unit heads 42 of one liquid ejecting module 36 overlap each other, as illustrated in FIGS. 2 and 5. The base portion 482 of Embodiment 1 includes the first surface 48A and a second surface 48B, as illustrated in FIGS. 3 and 4. The first surface 48A is a surface on the support body 32 side (in other words, the negative side in the Z direction). The second surface 48B is a surface on a side (in other words, the fixing plate 34 side) opposite to the first surface 48A.

The plurality of unit heads 42 are fixed, using, for example, an adhesive, to the first surface 48A of the base portion 482, as illustrated in FIGS. 3 and 4. Specifically, the respective unit heads 42 are fixed to the first surface 48A, in a state where front surfaces 426 (which are the mounting surfaces of the nozzle plate 424) of the main body portions 422 of the respective unit heads 42 are in close contact with the first surface 48A of the base portion 482. Accordingly, Z-direction positions of the plurality of unit heads 42 are determined with, as a criterion, the first surface 48A of the fixing plate 48. Furthermore, the plurality of unit heads 42 are fixed to the first surface 40A shared in common, as described above. As a result, there is also an advantage in that variation (in other words, variation in a gap between respective unit heads 42) in a gap between each unit head 42 and the first surface 40A is reduced, compared to variation in a gap between, for example, each unit head 42 and the casing body 44.

An opening portion 486 (in other words, a first opening portion) corresponding to the plurality of nozzles N of each unit head 42 is formed in the base portion 482, as illustrated in FIG. 5. Each opening portions 486 is a through-hole which extends in the WA direction so that the through-hole extends along the arrangement of the plurality of nozzles N and allows the plurality of nozzles N to be exposed. Specifically, in a plan view (when seen from the Z direction), the nozzle plate 424 of each unit head 42 is located in the opening portions 486. Peripheral edge portions of the fixing plate 48 are fixed to side surfaces of the casing body 44, using a fixing unit, such as an adhesive and a screw.

The fixing plate 34 (in other words, a second fixing plate) of FIG. 2 and the support body 32 support the plurality of liquid ejecting modules 36. The fixing plate 34 of Embodiment 1 includes a base portion 342, a side wall portion 344, and a side wall portion 346, as illustrated in FIGS. 2 to 4. The base portion 342 has a plate shape of which the thickness is substantially the same over the entirety of the surface thereof. The side wall portion 344 and the side wall portion 346 extend from a part of the base portion 342, which is each edge side extending in the X direction, to a negative side in the Z direction. A material and a manufacturing method of the fixing plate 34 are not limited. However, similarly to the fixing plate 48, the fixing plate 34 can be formed by, for example, bending a plate member formed of a high-rigidity material, such as stainless steel.

For convenience, in FIG. 5, the external appearance of the fixing plate 34 is illustrated by a dot-dash line. The base portion 342 of the fixing plate 34 is formed in a shape (specifically, a parallelogram shape extending in the X direction) and a size in which, in a plan view, the base portion 342 and the plurality of liquid ejecting modules 36 overlap each other, as can be understood from FIGS. 2 and 5. The base portion 342 of Embodiment 1 includes a mounting surface 34A and an ejection surface 34B, as illustrated in FIGS. 3 and 4. The mounting surface 34A is a surface on the plural liquid ejecting modules 36 side (in other words, the negative side in the Z direction). The ejection surface 34B is a surface (in other words, a surface facing the medium 12) on a side opposite to the mounting surface 34A.

The plurality of liquid ejecting modules 36 are fixed, using, for example, an adhesive, to the mounting surface 34A of the base portion 342, as illustrated in FIGS. 3 and 4. Specifically, the second surface 48B of the fixing plate 48 of each liquid ejecting module 36 is fixed to the mounting surface 34A of the base portion 342 of the fixing plate 34, in a state where the second surface 48B is in close contact with the mounting surface 34A. Accordingly, Z-direction positions of the plurality of liquid ejecting modules 36 are determined with, as a criterion, the mounting surface 34A of the fixing plate 34. Furthermore, the plurality of liquid ejecting modules 36 (in other words, the second surfaces 48B of the fixing plate 48) are fixed to the mounting surface 34A shared in common. As a result, there is also an advantage in that variation (in other words, variation in a gap between respective liquid ejecting modules 36) in a gap between each liquid ejecting module 36 and the mounting surface 34A is reduced, compared to variation in a gap between, for example, each liquid ejecting module 36 and the support body 32. The liquid ejecting module 36 is constituted by fixing the plurality of unit heads 42 to the fixing plate 48 shared in common and the liquid ejecting head 26 is constituted by fixing the plurality of liquid ejecting modules 36 to the fixing plate 34 shared in common, as described above.

The side wall portion 344 and the side wall portion 346 of the fixing plate 34 are fixed to a side surface of the support body 32, as can be understood from FIGS. 2 and 4. Specifically, the side wall portion 344 and the side wall portion 346 are fixed to the side surfaces of the support body 32, using a fixing unit, such as an adhesive and a screw. According to the configuration described above, the fixing plate 34 is fixed to the support body 32 having a high mechanical strength, and thus deformation of the fixing plate 34 can be prevented.

An opening portion 348 (in other words, a second opening portion) corresponding to the plurality of nozzles N of each unit head 42 of each liquid ejecting module 36 is formed in the base portion 342 of the fixing plate 34, as illustrated in FIGS. 2 to 4. Each opening portion 348 extends in the WA direction so that the opening portion 348 extends along the arrangement of the plurality of nozzles N, similarly to the opening portions 486. Thus, in a plan view, the opening portion 348 and the opening portions 486 overlap each other. Accordingly, the plurality of nozzles N of each unit head 42 are exposed through both the opening portions 486 of the fixing plate 48 and the opening portion 348 of the fixing plate 34.

Figure 6:
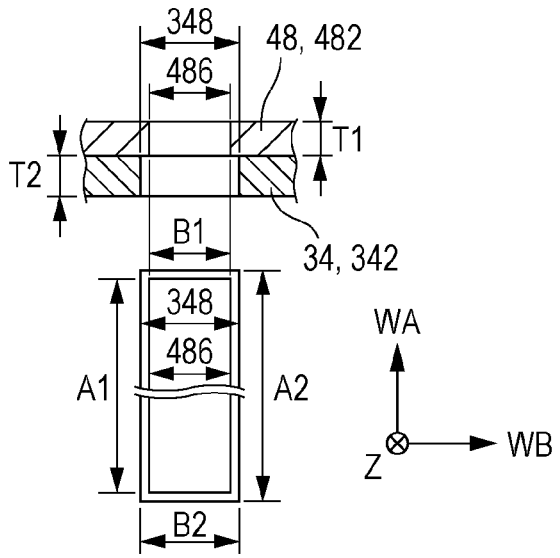
FIG. 6 is a cross-sectional view and a plan view for explaining each opening portion of a fixing plate.

FIG. 6 is an explanatory view of the relationship between the opening portions 486 of the fixing plate 48 and the opening portion 348 of the fixing plate 34. In a plan view, the size of the opening portion 348 is larger than that of the opening portions 486, as illustrated in FIG. 6. Specifically, a length (in other words, an overall length) A2 of the opening portion 348 in the WA direction is greater (A2>A1) than a length A1 of the opening portions 486. In addition, a length (in other words, a width) B2 of the opening portion 348 in a WB direction perpendicular to the WA direction is greater (B2>B1) than a length B1 of the opening portions 486. According to the configuration described above, there is an advantage in that, even when an error occurs in the position of each liquid ejecting module 36 in relation to the fixing plate 34, a possibility that a part of the opening portions 486 or the entirety of the opening portions 486 may be closed by the fixing plate 34 is reduced. In other words, a required condition of the positional accuracy of each liquid ejecting module 36 in relation to the fixing plate 34 is eased (in other words, the alignment between the respective liquid ejecting modules 36 is eased).

A thickness T2 of the fixing plate 34 (in other words, the base portion 342) is greater (T2>T1) than a thickness T1 of the fixing plate 48 (in other words, the base portion 482), as illustrated in FIG. 6. Accordingly, when it is assumed that the fixing plate 34 and the fixing plate 48 are constituted of the same material, the mechanical strength (in other words, the bending rigidity) of the fixing plate 34 is greater than that of the fixing plate 48. According to the configuration described above, there is an advantage in that it is easy for the fixing plate 34 to have a mechanical strength necessary to support the plurality of liquid ejecting modules 36, compared to a configuration (for example, a configuration in which the thickness T2 is less than the thickness T1) in which the mechanical strength of the fixing plate 34 is less than that of the fixing plate 48.

A gap G can be formed in a portion between adjacent liquid ejecting modules 36 in the X direction, as illustrated in FIGS. 3 and 5. Specifically, in the portion between the adjacent liquid ejecting modules 36, a space interposed between the outer circumferential surface of the side wall portion 484 of the fixing plate 48, the side surface of the casing body 44, and the side surface of the flow path body 46 corresponds to the gap G. The fixing plate 34 of Embodiment 1 and the gap G between the respective liquid ejecting modules 36 overlap in the Z direction, as illustrated in FIG. 3. Specifically, a part of the base portion 342, which is a portion 34C located in a portion between the respective opening portions 348, and the gap G overlap in the Z direction. Furthermore, the side wall portion 344 and the side wall portion 346 of the fixing plate 34 and the gap G between the respective liquid ejecting modules 36 overlap in the Y direction, as can be understood from FIG. 5. In other words, the gap G between the adjacent liquid ejecting modules 36 is closed, in the Z direction, by the base portion 342 and, further, the gap G is closed, in the Y direction, by both the side wall portion 344 and the side wall portion 346.

In Embodiment 1, the fixing plate 34 (in other words, the base portion 342) and the gap G of the respective liquid ejecting modules 36 overlap in the Z direction, as described above, and thus the ink can be prevented from entering the gap G. Furthermore, the gap G is closed by the base portion 342. Thus, there is an advantage in that, even when the medium 12 comes into contact, from the Z direction, with the liquid ejecting head 26, in a state where the ink stays in, for example, the gap G, the ink in the gap G does not adhere to the medium 12. Particularly, in Embodiment 1, the side wall portion 344 and the side wall portion 346 of the fixing plate 34 overlap, in the Y direction, the gap G of the respective liquid ejecting modules 36. Thus, a special effect that the ink can be prevented from entering the gap G from the Y direction is obtained. Furthermore, the side wall portion 344 and the side wall portion 346 close the gap G from the Y direction. Thus, there is an advantage in that, even when the medium 12 comes into contact, from the Y direction, with the liquid ejecting head 26, in a state where the ink stays in, for example, the gap G, the ink in the gap G does not adhere to the medium 12.

Figure 7:
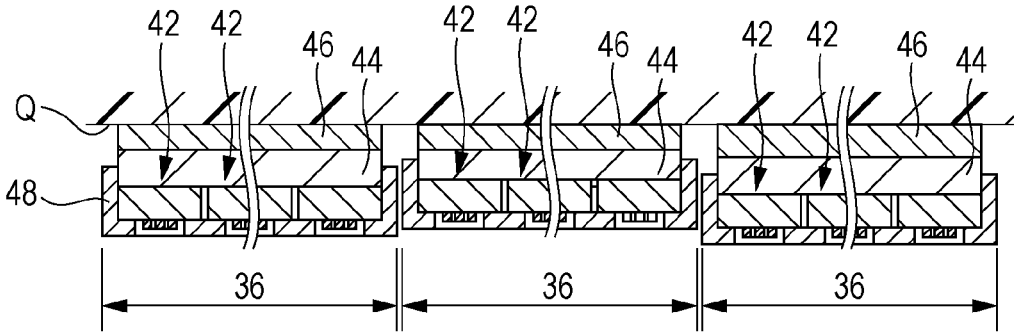
FIG. 7 is an explanatory view of a comparative example.

Meanwhile, a configuration (hereinafter, referred to as a "comparative example") in which, when viewed from the liquid ejecting module 36, the plurality of liquid ejecting modules 36 are fixed to a surface (hereinafter, referred to as a "reference surface") Q on the negative side in the Z direction can be conceived as a configuration in which the plurality of liquid ejecting modules 36 having the plurality of unit heads 42 fixed to the first surface 48A of the fixing plate 48 are fixed, as illustrated in, for example, FIG. 7. However, in the configuration of the comparative example, when an error occurs in the size of the support body 32 or the flow path body 46 which is located on the negative side in the Z direction, when viewed from the main body portion 422 of each unit head 42, there is a problem in that the Z-direction position of each unit head 42 is different for each liquid ejecting module 36, as can be understood from FIG. 7. However, in Embodiment 1, the plurality of unit heads 42 are fixed to the first surface 48A of the fixing plate 48 and, further, the plurality of liquid ejecting modules 36 are fixed to the mounting surface 34A of the fixing plate 34. In other words, the Z-direction positions of the plurality of unit heads 42 are determined with, as a criterion, the first surface 48A which is located on the positive side in the Z direction when viewed from each unit head 42. Furthermore, the Z-direction positions of the plurality of liquid ejecting modules 36 are determined with, as a criterion, the mounting surface 34A which is also located on the positive side in the Z direction when viewed from each unit head 42. Accordingly, even when an error occurs in the size of each unit head 42, the support body 32 or the flow path body 46, the Z-direction positions of the respective unit heads 42 can be set (in other words, can be made to matched throughout, for example, the plurality of liquid ejecting modules 36) with high accuracy, in relation to the liquid ejecting module 36.

Manufacturing Method of Liquid Ejecting Head 26

Figure 8:
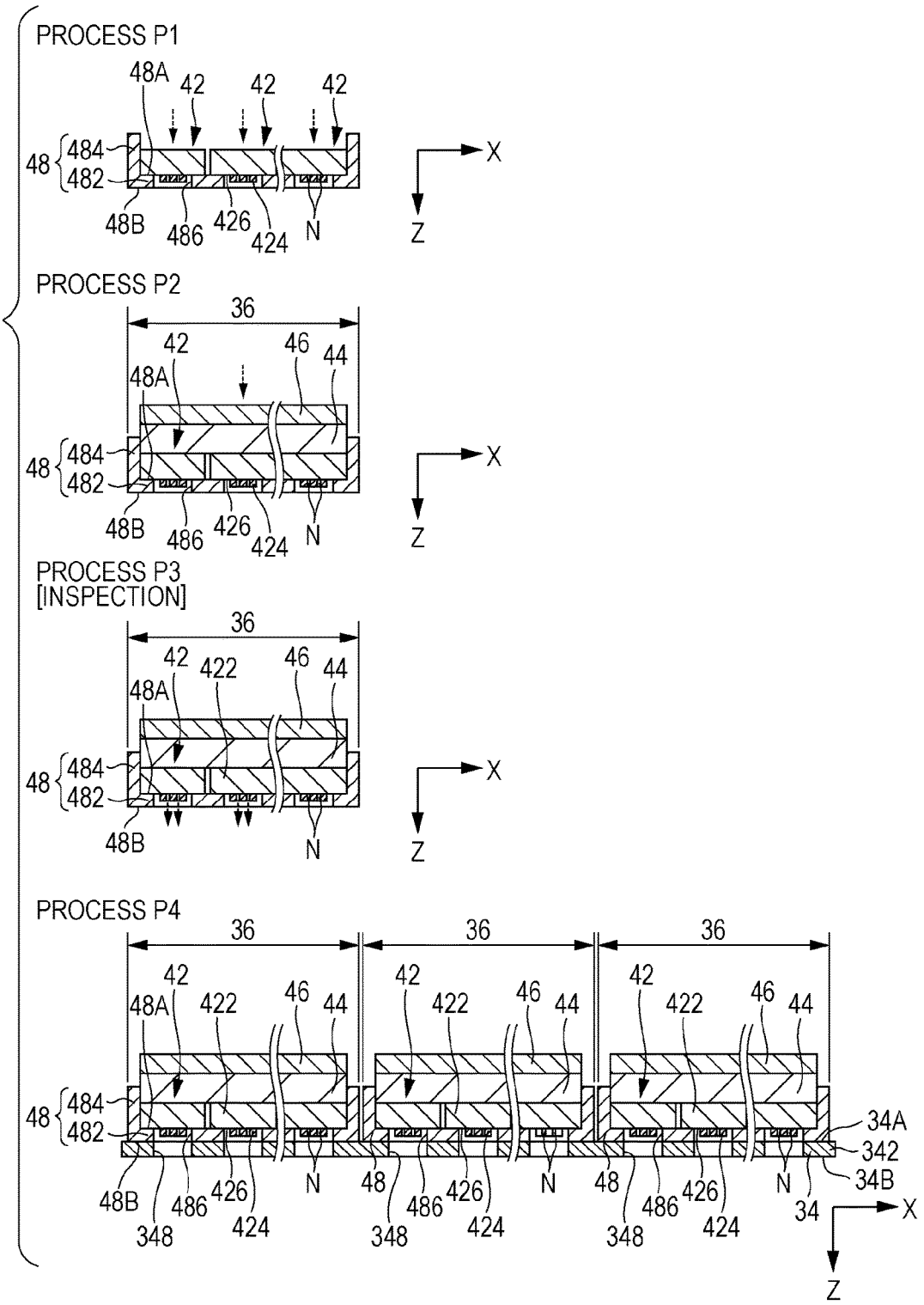
FIG. 8 is a process drawing illustrating a manufacturing method of the liquid ejecting head of Embodiment 1.

Hereinafter, the manufacturing method (in other words, the assembling method) of the liquid ejecting head 26 described above will be described. FIG. 8 is an explanatory view of processes of manufacturing the liquid ejecting head 26.

In a process P1 and a process P2, assembling of each liquid ejecting module 36 is performed. In the process P1 performed at first, the plurality of unit heads 42 are fixed to the fixing plate 48. Specifically, the front surface 426 of each unit head 42 is fixed, using, for example, an adhesive, to the first surface 48A of the base portion 482 of the fixing plate 48, in a state where the position of each unit head 42 is adjusted in relation to the fixing plate 48 so that each nozzle N of each unit head 42 is located at a target position. Accordingly, the Z-direction positions of the plurality of unit heads 42 constituting the liquid ejecting module 36 are determined with the first surface 48A as a criterion. Specifically, the front surfaces 426 of the plurality of unit heads 42 are located in the same plane. In the process P2 following the process P1, the fixing plate 48 is fixed to both the casing body 44 and the flow path body 46, in a state where the plurality of unit heads 42 fixed to the fixing plate 48 are accommodated in the casing body 44. During the processes described above, the liquid ejecting module 36 is manufactured.

In a process P3, inspection of the liquid ejecting module 36 is performed. Specifically, the suitability (in other words, ejection/non-ejection or the amount of ink ejected) of ink ejection by the respective nozzles N of each unit head 42 is inspected. The liquid ejecting module 36 is inspected in a state where the ink is supplied to each unit head 42 through the flow path body 46, similarly to in a case of actual use of the printing apparatus 10, as described above. Furthermore, in a case of the liquid ejecting head 26 in which the plurality of liquid ejecting modules 36 are mounted on both the support body 32 and the fixing plate 34, when, for example, one unit head 42 is a defective unit, the entirety of the liquid ejecting head 26 is determined as a defective unit. However, in Embodiment 1, failure or non-failure is determined for each liquid ejecting module 36, and thus there is an advantage in that a manufacturing cost can be reduced, compared to in a case where an inspection target is the liquid ejecting head 26.

In a process P4, the plurality of liquid ejecting modules 36 which are determined as non-defective units by inspection during the process P3 are fixed to the fixing plate 34. Specifically, the second surface 48B of the fixing plate 48 of each liquid ejecting module 36 is fixed, using, for example, an adhesive, to the mounting surface 34A of the base portion 342 of the fixing plate 34. Accordingly, the Z-direction positions of the plurality of liquid ejecting modules 36 are determined with the mounting surface 34A as a criterion. Specifically, the second surfaces 48B of the fixing plates 48 of each liquid ejecting module 36 are located in the same plane. After the process P4 is performed, the fixing plate 34 is fixed to the support body 32, in a state where the plurality of the liquid ejecting modules 36 are accommodated in the support body 32, in such a manner that the liquid ejecting head 26 of Embodiment 1 illustrated in FIG. 3 is manufactured.

Embodiment 2

Embodiment 2 of the invention will be described. Furthermore, in each configuration described below, the reference numerals and letters which are used in the description of Embodiment 1 are given to components of which the operations and the functions are the same as those of Embodiment 1. The details of the configurations of these components will be appropriately omitted.

Figure 9:
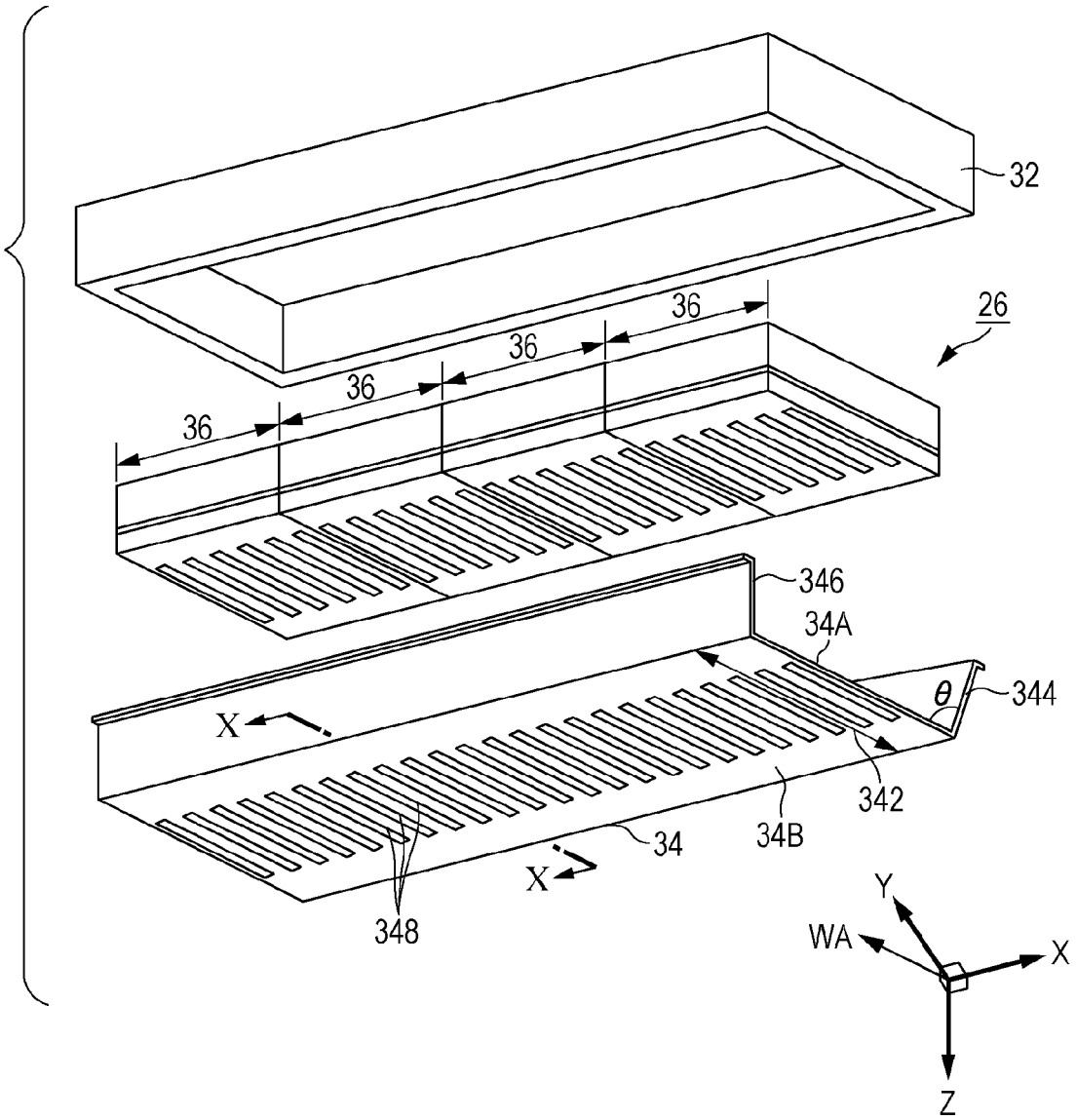
FIG. 9 is an exploded perspective view of a liquid ejecting head according to Embodiment 2.
Figure 10:
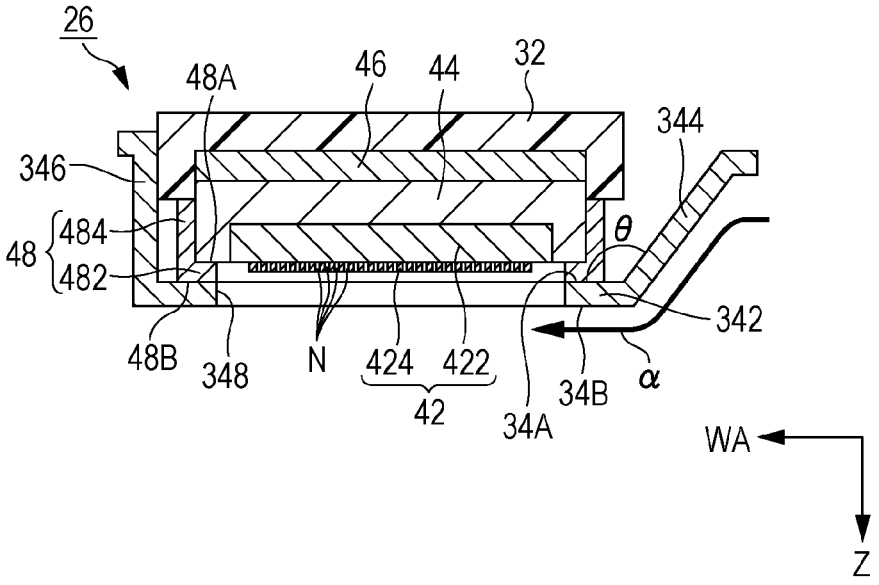
FIG. 10 is a cross-sectional view taken along the line X-X of FIG. 9.

FIG. 9 is an exploded perspective view of the liquid ejecting head 26 of Embodiment 2 and FIG. 10 is a cross-sectional view (in other words, a view of a cross-sectional surface parallel to a WA-Z plane) taken along a line X-X of FIG. 9. The shape of the fixing plate 34 of Embodiment 2 is different from that of Embodiment 1, as illustrated in FIGS. 9 and 10. Specifically, a part of the fixing plate 34 of Embodiment 2, which is the side wall portion 344 located on the negative side (in other words, an upstream side in a transport direction of the medium 12) in the Y direction, is inclined with respect to the base portion 342. Specifically, the side wall portion 344 and the base portion 342 are inclined (in other words, non-perpendicularly cross) at an obtuse angle θ (90°<θ<180°).

Embodiment 2 can obtain the same effect as that of Embodiment 1. Furthermore, in Embodiment 2, the side wall portion 344 and the base portion 342 cross at the obtuse angle θ. Thus, when the leading edge of the medium 12 transported from the negative side to the positive side in the Y direction reaches the side wall portion 344, the medium 12 is guided, along the side wall portion 344, to the ejection surface 34B side of the fixing plate 34, as illustrated by an arrow α in FIG. 10. Accordingly, there is an advantage in that a possibility that movement of the medium 12 may be hindered by the side wall portion 344 and a possibility that deformation, such as folding, of the medium 12 may occur due to collision between the medium 12 and the side wall portion 344 can be reduced.

Modification Examples

The embodiments described above can be modified in various ways. Specific modification examples will be described below. Two or more modification examples which are arbitrarily selected from the examples described below can be appropriately used in combination as long as they do not conflict with each other.

Figure 11:
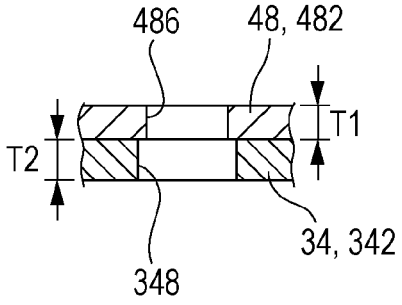
FIG. 11 is an explanatory view of the thickness of each fixing plate of a modification example.

(1) In the embodiments described above, the configuration in which the thickness T2 of the fixing plate 34 is greater (T2>T1) than the thickness T1 of the fixing plate 48 is exemplified. However, a configuration in which the thickness T2 of the fixing plate 34 is less (T2<T1) than the thickness T1 of the fixing plate 48 can also be applied, as illustrated in FIG. 11. In a configuration in which a gap (in other words, a platen gap) between the surface of the medium 12 and the nozzles N is large, there is a possibility that an ink traveling direction may change during a period in which the ink ejected from each nozzle N lands on the surface of the medium 12, and this thus resulting in an occurrence of an error in the landing position. According to the configuration of FIG. 11, the thickness T2 of the fixing plate 34 is reduced, compared to Embodiment 1. Thus, a gap between the nozzles N (in other words, the surface of the nozzle plate 424) of the unit head 42 and the surface of the medium 12 is reduced. In other words, the respective nozzles N can be located closer to the medium 12. Accordingly, there is an advantage in that an error in the landing position of the ink in relation to the medium 12 can be reduced.

(2) In Embodiment 2, the configuration in which a part of the fixing plate 34, which is the side wall portion 344 located on the negative side in the Y direction, is inclined with respect to the base portion 342 is exemplified. However, in addition to the configuration described above (or instead of the configuration described above), the configuration in which a part of the fixing plate 34, which is the side wall portion 346 located on the positive side (in other words, on the downstream side in the transport direction of the medium 12) in the Y direction is inclined with respect to the base portion 342 at an obtuse angle can also be applied. According to the configuration described above, in a configuration in which, for example, the transport direction of the medium 12 can be reversed, the medium 12 transported from the positive side to the negative side in the Y direction can be guided, along the side wall portion 346, to the ejection surface 34B side of the fixing plate 34.

(3) In the embodiments described above, the printing apparatus 10 of a line type in which the plurality of unit heads 42 are aligned over the entirety of the width of the medium 12 is exemplified. However, the invention can also be applied to a printing apparatus of a serial type in which a carriage having the liquid ejecting head 26 mounted thereon reciprocates in the X direction.

(4) The ink ejection type of the unit head 42 is not limited to the above-described type (in other words, a piezo type) using a piezoelectric element. The invention can also be applied to a liquid ejecting head of a type (in other words, a thermal type) using a heating element which causes air bubbles to be generated in the pressure chamber by heating and changes the pressure of a pressure chamber.

(5) The printing apparatus 10 exemplified in the embodiments described above can be applied to various apparatuses, such as a facsimile machine and a copy machine, other than an apparatus dedicated to printing. Furthermore, the use of the liquid ejecting apparatus of the invention is not limited to printing. A liquid ejecting apparatus ejecting, for example, a colorant solution may be used as a manufacturing apparatus which forms a color filter for a liquid crystal display device. Furthermore, a liquid ejecting apparatus ejecting a solution of a conductive material is used as a manufacturing apparatus which forms wiring and an electrode of a wiring substrate.

What is claimed is:

1. A liquid ejecting head comprising:

a plurality of liquid ejecting modules, each ejecting module including:

a plurality of unit heads each configured to eject liquid from a plurality of nozzles, and a first fixing plate having a first surface where the plurality of unit heads are fixed; and a second fixing plate having a base portion where second surfaces of the first fixing plates of the plurality of liquid ejecting modules are fixed with a gap between adjacent first fixing plates, the second surface located on the side opposite to the first surface such that the first fixing plate is between the plurality of unit heads and the second fixing plate, and the base portion overlapping the gap, wherein the gap is defined by the adjacent first fixing plates in a plan view of the second fixing plate.

2. The liquid ejecting head according to claim 1, wherein a first opening portion corresponding to the unit head is formed in the first fixing plates, wherein a second opening portion corresponding to the unit head is formed in the second fixing plate, and wherein, in a plan view, the size of the second opening portion is greater than that of the first opening portion.

3. A liquid ejecting apparatus comprising:

the liquid ejecting head according to claim 2.

4. The liquid ejecting head according to claim 1, wherein the plurality of liquid ejecting modules are aligned in a first direction, and wherein the second fixing plate includes a side wall portion which extends from a peripheral edge of the base portion, which extends in the first direction, to each liquid ejecting module side and overlaps a gap between the adjacent liquid ejecting modules.

5. The liquid ejecting head according to claim 4, wherein an angle between the side wall portion and the base portion is an obtuse angle.

6. A liquid ejecting apparatus comprising:

the liquid ejecting head according to claim 5.

7. A liquid ejecting apparatus comprising:

the liquid ejecting head according to claim 4.

8. The liquid ejecting head according to claim 1, further comprising:

a support body which supports the plurality of liquid ejecting modules, wherein the second fixing plate is fixed to the support body.

9. A liquid ejecting apparatus comprising:

the liquid ejecting head according to claim 8.

10. The liquid ejecting head according to claim 1, wherein a thickness of the second fixing plate is greater than that of the first fixing plates.

11. A liquid ejecting apparatus comprising:

the liquid ejecting head according to claim 10.

12. The liquid ejecting head according to claim 1, wherein a thickness of the first fixing plates is greater than that of the second fixing plate.

13. A liquid ejecting apparatus comprising:

the liquid ejecting head according to claim 12.

14. A liquid ejecting apparatus comprising:

the liquid ejecting head according to claim 1.

15. The liquid ejecting head according to claim 1, wherein the liquid ejecting module includes a casing body configured to support the plurality of unit heads, wherein a variation in first gaps is smaller than a variation in second gaps, the first gaps defined between the unit heads and the first surface, the second gaps defined between the unit heads and the casing body.

16. The liquid ejecting head according to claim 1, further comprising:

a support body configured to support the plurality of liquid ejecting modules, wherein a variation in third gaps is smaller than a variation in fourth gaps, the third gaps defined between the liquid ejecting modules and the base portion, the fourth gaps defined between the liquid ejecting modules and the support body.

* * * * *